US007721451B2

(12) United States Patent
Psimadas et al.

(10) Patent No.: US 7,721,451 B2
(45) Date of Patent: May 25, 2010

(54) RAZOR EQUIPPED WITH SEVERAL ROTATING SHAVING HEADS

(75) Inventors: Yiannis Psimadas, Athens (GR); Spiros Gratsias, Athens (GR); Yiannis Bozikis, Athens (GR)

(73) Assignee: Bic-Violex S.A., Anixi, Attiki (GR)

( * ) Notice: Subject to any disclaimer, the term of this patent is extended or adjusted under 35 U.S.C. 154(b) by 0 days.

(21) Appl. No.: 11/572,491

(22) PCT Filed: Jul. 22, 2004

(86) PCT No.: PCT/EP2004/009162

§ 371 (c)(1),
(2), (4) Date: Apr. 28, 2007

(87) PCT Pub. No.: WO2006/007873

PCT Pub. Date: Jan. 26, 2006

(65) Prior Publication Data

US 2007/0214647 A1 Sep. 20, 2007

(51) Int. Cl.
*B26B 21/14* (2006.01)
*B26B 21/30* (2006.01)

(52) U.S. Cl. ..... 30/527; 30/34.1; 30/50; 30/155

(58) Field of Classification Search ..... 30/34.1, 30/194, 211, 223, 233, 244, 260, 526–534, 30/40, 152, 50, 57; D28/44–48
See application file for complete search history.

(56) References Cited

U.S. PATENT DOCUMENTS 978,165 A * 12/1910 Johnson ..... 30/161
1,791,428 A 2/1931 Riviere
2,565,062 A * 8/1951 Blanchard ..... 30/32
2,574,472 A * 11/1951 Galvao ..... 30/43.6
3,430,341 A * 3/1969 Choate ..... 30/40
3,579,824 A * 5/1971 Matsumoto et al. ..... 30/43.92
3,619,900 A * 11/1971 Matsuura ..... 30/40
3,648,365 A * 3/1972 Iten et al. ..... 30/40
3,722,091 A 3/1973 Gagnon
3,905,099 A * 9/1975 Bernstrom ..... 30/41.5
4,241,500 A * 12/1980 Iten ..... 30/40
4,461,078 A * 7/1984 Carreker ..... 30/47
4,492,024 A 1/1985 Jacobson
5,010,645 A 4/1991 Furukawa
5,206,994 A 5/1993 Lin (Continued)

FOREIGN PATENT DOCUMENTS

FR 2 632 886 12/1989

(Continued)

*Primary Examiner*—Boyer D. Ashley
*Assistant Examiner*—Edward Landrum
(74) *Attorney, Agent, or Firm*—Jones Day

(57) ABSTRACT

A razor that includes a handle having an axis, at least a first and a second shaving head, and a drum that includes the first and second shaving head. The drum is pivotally mounted onto the handle about an axis substantially perpendicular to the edges of the blades, the pivoting of the drum allowing at least a first configuration in which the first shaving head projects at a front end of the handle to allow shaving while the second shaving head is at least partly covered by the handle. In a second configuration, the positions of the first shaving head and second shaving head are reversed.

12 Claims, 3 Drawing Sheets

U.S. PATENT DOCUMENTS

| | | | | |
|---|---|---|---|---|
| 5,784,785 | A | 7/1998 | Polites | |
| 5,980,452 | A * | 11/1999 | Garenfeld et al. | 600/133 |
| 6,032,365 | A | 3/2000 | Hodges et al. | |
| 6,052,905 | A * | 4/2000 | Branchinelli et al. | 30/50 |
| 6,622,327 | B1 * | 9/2003 | Rivera | 7/128 |
| 6,928,738 | B2 | 8/2005 | Segrea | |

FOREIGN PATENT DOCUMENTS

| | | |
|---|---|---|
| FR | 2 829 716 | 3/2003 |
| GB | 205907 | 7/1922 |
| JP | 8-257263 | 10/1996 |
| WO | WO 97/27030 | 7/1997 |

* cited by examiner

RAZOR EQUIPPED WITH SEVERAL ROTATING SHAVING HEADS

FIELD OF THE INVENTION

The embodiments of the present invention relate to safety razors and, more specifically, to a razor comprising several shaving heads which can be alternatively exposed for shaving upon actuation of a movable mechanism by a user.

BACKGROUND OF THE INVENTION

International application No. WO 97/27030 discloses a razor with a reversible blade unit, in order to extend the useful life of the blade unit.

The blade unit is engaged into a housing and is provided with turning knobs, located at either end of the blade unit. Upon the dulling of the cutting edges on one side of the blade unit, the user turns the knobs such that the dulled cutting edges are rotated to the rear of the housing while the still sharp, unused cutting edges are rotated such that they are exposed at the front of the housing and are then ready for use.

One disadvantage of such a razor is that, when the user wants to turns the knobs, his soapy hands might slip on the knobs, thereby preventing him from turning the blade unit in a single movement.

Another disadvantage of such a razor is that it is quite dangerous for the user, for as the knobs are thin and located near the blades, any wrong move might result in the user cutting his fingers.

SUMMARY OF THE INVENTION

It is an object of an embodiment of the present invention to provide a razor having several blades which can be alternatively exposed for shaving upon actuation of a movable mechanism by a user.

It is also an object of the embodiments of the present invention to provide such a razor, the use and actuation of which is safe.

It is a further object of the embodiments of the present invention to provide such a razor, the actuation of which is simple and rapid.

The razor according to the embodiments of the present invention comprises a handle having an axis, at least a first and a second shaving head attached to a common drum which is pivotally mounted onto the handle about an axis substantially perpendicular to the edges of the blades, between a first configuration in which said first head projects at a front end of the handle to allow shaving while the second head is at least partly covered by the handle, and a second configuration in which the positions of the heads are reversed.

Simple rotation of the drum allows the user to select either the first or the second shaving head.

The shaving heads are preferably parallel and diametrically opposed from each other with respect to the drum and they face away from each other, so that interchangeability of the shaving heads is achieved by a 180° rotation of the drum.

In one preferred embodiment of the present invention, the shaving heads have different sizes, the first one being of standard width whereas the second one has a width which is less than the standard width.

Each shaving head may include a removable cartridge, which is to be replaced as soon as the blades are dulled.

An actuating mechanism may be provided for rotating the drum. This actuating mechanism comprises, for example, a gear attached to the drum and a rack engaging said gear and attached to a manually operable actuator slidingly mounted on the handle.

The above and other objects and advantages of the embodiments of the present invention will become apparent from the detailed description of a preferred embodiment of the invention, considered in conjunction with the accompanying drawings.

Figures 1, 2, 3:
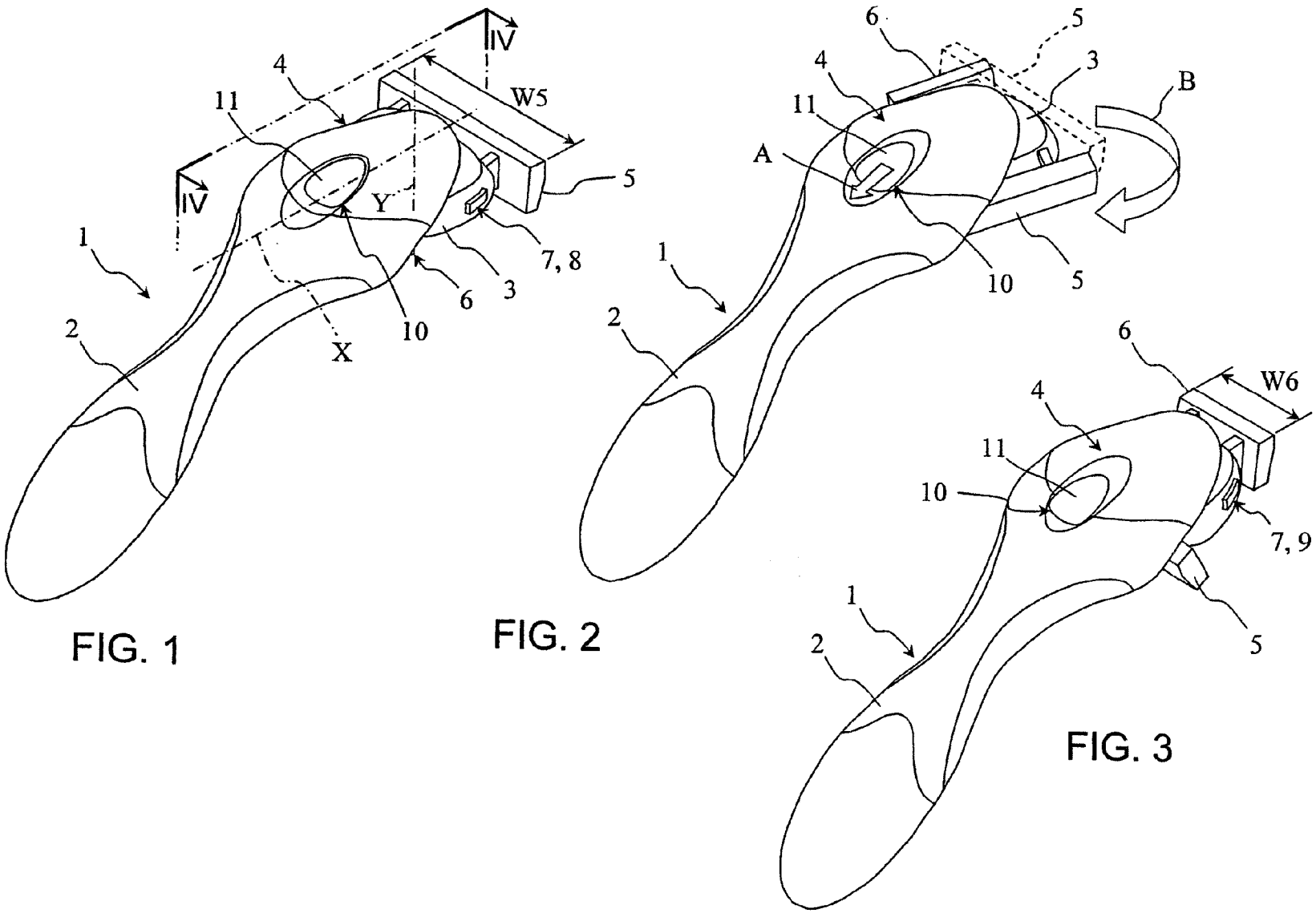
FIG. 1 is a perspective view of a razor having two shaving heads of different sizes mounted on a common rotating drum, shown in a first configuration.
FIG. 2 is a perspective view of the razor of FIG. 1, during rotation of the drum from a first configuration to a second configuration.
FIG. 3 is a perspective view of the razor of FIGS. 1 and 2, shown in a second configuration.

A razor according to an embodiment of the present invention is indicated generally by reference number 1 in the drawings. Razor 1 comprises an elongated handle 2 which has a longitudinal axis X.

Razor 1 comprises a drum 3 mounted on the handle 2 at a front end 4 thereof. Drum 3 is capable of rotating, with respect to the handle 2, about an axis Y substantially perpendicular to the handle axis X, At least a first blade unit or head 5, and a second blade unit or head 6, each having one or more blades 5*a*, 6*a*, are attached to the drum 3 so that the edges of the blades 5*a*, 6*a* are substantially perpendicular to the drum axis Y.

The heads 5, 6 are parallel and diametrically opposed to each other with respect to the drum 3, so that they face away with respect to each other.

Razor 1 may be either entirely disposable, or have a reusable handle 2 (as shown in the illustrated preferred embodiment).

In the first case, the heads 5, 6 are permanently attached to the drum 3, so that as soon as the blade edges are dulled the entire razor 1 is disposed of.

In the second case (which is the one illustrated in FIGS. 1-3), each head 5, 6 may include a replaceable cartridge which is removably attached to the drum 3 by movable latching means 7 so that after the blade edges are dulled only the cartridges are disposed of and replaced by new ones.

Latching means 7 comprise, e.g., two pairs of side buttons 8, 9 which, upon side pressing from the user's fingers, release the corresponding head 5, 6 to allow mounting of a new one. One skilled in the art may be inspired by existing release mechanisms (see, e.g., U.S. Pat. No. 4,492,024).

In an alternative embodiment (not illustrated), the entire drum 3 may include a whole replaceable cartridge which is removably attached to the handle 3, so that after the blade edges are dulled the drum 3 is completely disposed of and replaced by a new one.

The heads 5, 6 preferably have different sizes, the first one 5 having a standard width W5 while the second one 6 has a width W6 which is less than W5.

Standard head 5 is used in normal shaving (cheek hair), while the narrow one 6 is dimensioned for easy maneuverability to facilitate accurate trimming of particular hair areas, e.g. moustaches.

Figure 8:
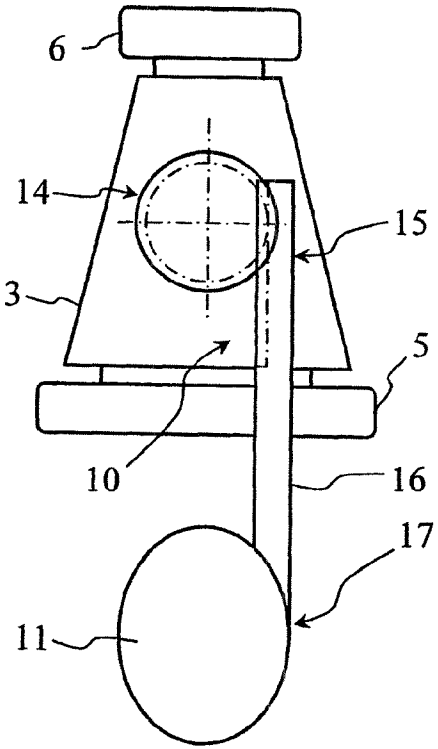
FIGS. 6-8 are partial top views showing the actuation mechanism from the first configuration (FIG. 6) to the second configuration (FIG. 8), rotation of the drum being shown on FIG. 7.

Drum 3 is capable of rotating between:

a first configuration (FIGS. 1, 4, 6) in which standard head 5 projects and faces outward at the front end 4 of the handle 2 while narrow head 6 faces inwards with respect to handle 2, and a second configuration (FIGS. 2, 5, 8) which is 180° from the first configuration and in which the orientations of the heads 5, 6 are reversed.

In the first configuration, standard head 5 is ready for use to allow shaving while narrow head 6, which is at least partly covered by the handle 2, is inoperable (FIG. 1).

In the second configuration, the situation is reversed: narrow head 6 is ready for use to allow shaving while standard head 5, which is at least partly covered by the handle 2, is inoperable (FIG. 3).

Razor 1 further comprises an actuating mechanism 10 for moving the drum 3, which comprises a manually operable actuator 11 mounted on the handle 2.

Figure 4:
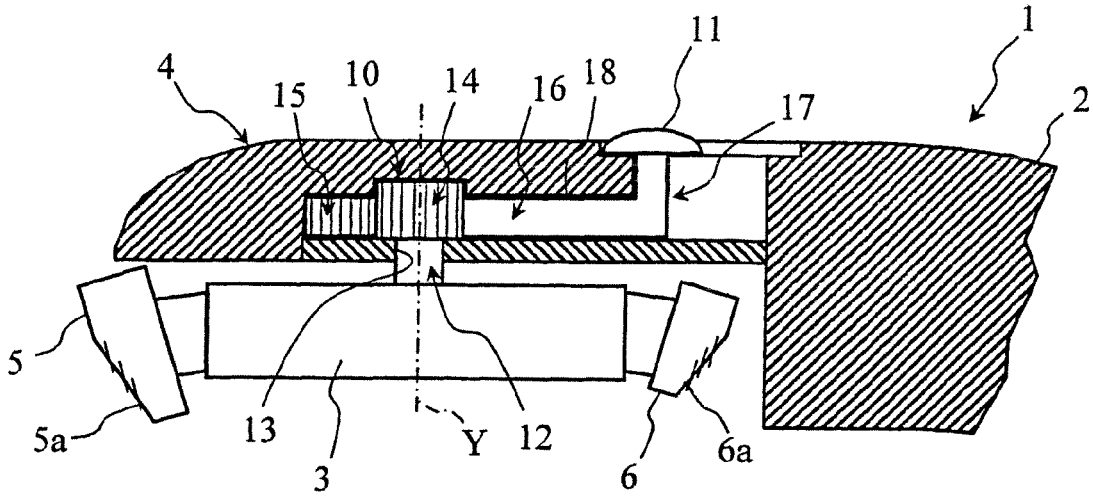
FIG. 4 is a side elevational cut view of the razor of FIG. 1, taken on the plane IV-IV, partly showing the razor in the first configuration.
Figure 5:
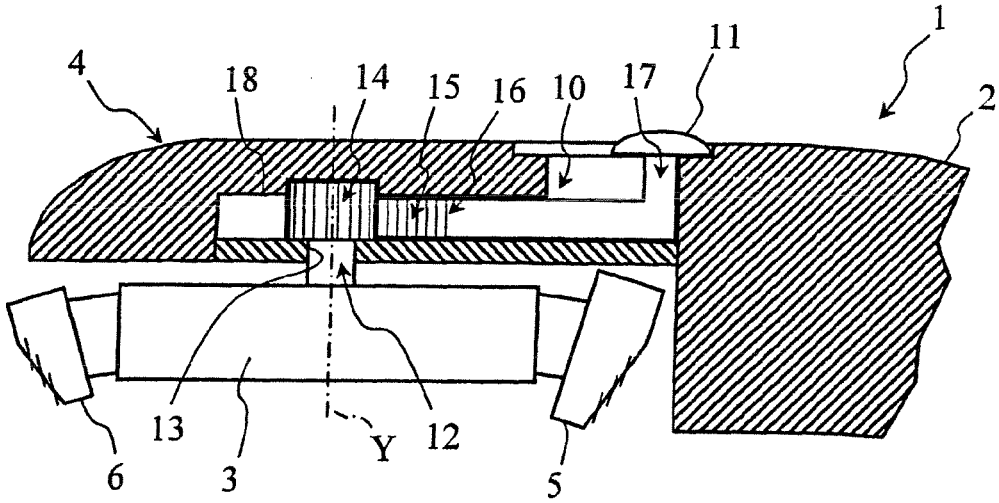
FIG. 5 is a side elevational cut view similar to FIG. 4, partly showing the razor in second configuration.
Figure 6:
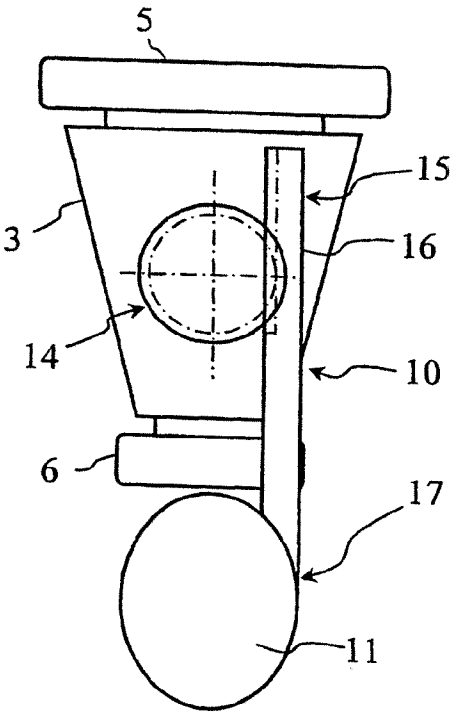

As depicted on FIGS. 4 and 5, drum 3 is pivotally mounted in the front end 4 of the handle 2 through a shaft 12 attached to the drum 3 and introduced in a corresponding bore 13 formed in the handle 2.

One end of the shaft 12, opposite the drum 3, forms a gear 14 engaging a front end portion 15 of a rack 16 on a back end 17 of which actuator 11 is attached.

Rack 16 is slidingly mounted in a longitudinal groove 18 formed, adjacent the bore 13, in the front end 4 of the handle 2, between:

a first extreme position (FIG. 6), corresponding to the first configuration of the drum 3 (FIGS. 1, 4), and a second extreme position (FIG. 8), corresponding to the second configuration of the drum 3 (FIGS. 3, 5).

Figure 7:
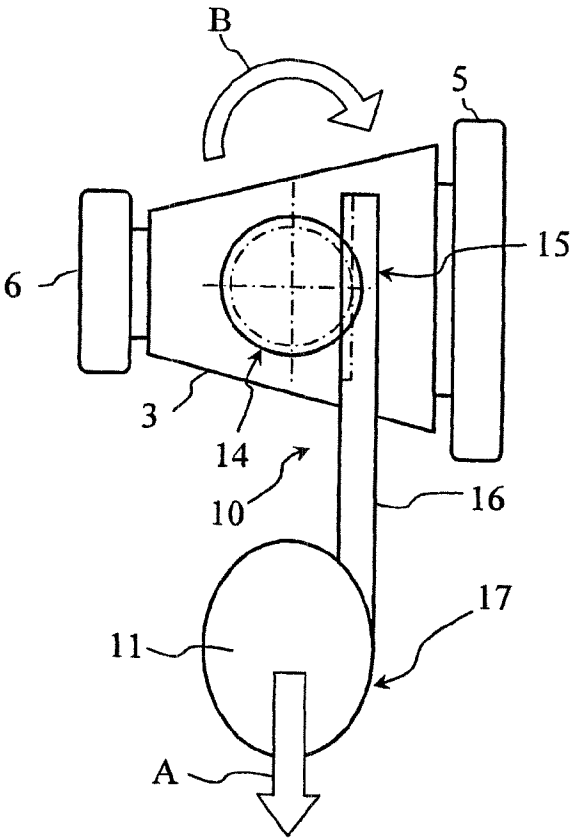

Starting from the first extreme position/first configuration (FIGS. 1 and 6), wherein standard head 5 is ready for shaving, simple backwards action of the thumb on the actuator 11 slides the rack 16 towards the second extreme position (arrow A, FIGS. 2 and 7), while drum 3 rotates 180° to its second configuration (arrow B, FIGS. 2 and 7), thereby presenting narrow head 6 as ready for shaving.

The reversed action slides back the rack 16 to its first extreme position, while drum 3 is rotated back to its first configuration.

Hence, the user can selectively use the standard head 5 or the narrow head 6, whichever is the most convenient to him/her. As long as, during use of the one head, the other head is at least partly hidden under the front end 4 of the handle 2, there are few risks for the user to cut his/her fingers or to damage the blades. Therefore, there is no need to be particularly more careful than with a common safety razor.

Selection of either of the heads, done by short thumb action, is simple and quick. As dimensions of razor 1 are quite the same as a common safety razor's, gripping razor 1 is achieved in a standard way.

The invention claimed is:

1. A wet razor comprising:

a handle;

at least a first and a second shaving head, wherein each of the first and second shaving heads are elongated and extend along a width, wherein the first shaving head has one or more blades, each of the blades having one cutting edge extending parallel to the width of the first shaving head, wherein the second shaving head has one or more blades, each of the blades having one cuffing edge extending parallel to the width of the second shaving head, a drum that includes said at least first and second shaving head, said drum being pivotally mounted onto said handle about an axis substantially perpendicular to the cuffing edges of the blades of said at least first and second shaving head, the pivoting of said drum allowing selective use of the first shaving head or of the second shaving head, the drum being able to pivot between at least a first configuration in which said first shaving head projects at a front end of said handle to allow shaving while said second shaving head is at least partly covered by said handle, and a second configuration in which the positions of said first shaving head and said second shaving head are reversed, and an actuating mechanism connected to said drum that causes rotation of said drum between the first and second configurations and including a manually operable actuator slidingly mounted on the handle to actuate the pivoting of said drum.

2. A razor according to claim 1, wherein said at least first and second shaving head are parallel and diametrically opposed from each other with respect to said drum, and wherein said at least first and second shaving head face away from each other.

3. A razor according to claim 2, wherein said at least first and second shaving head have different sizes.

4. A razor according to claim 3, wherein said first shaving head includes a width greater than a width of said second shaving head.

5. A razor according to claim 1, wherein the actuating mechanism includes a gear attached to said drum and a rack engaging the gear and attached to the manually operable actuator slidingly mounted on said handle.

6. A razor according to claim 5, wherein the rack is slidingly mounted in a longitudinal groove formed in the front end of the handle, between a first extreme position, corresponding to the first configuration of the drum, and a second extreme position, corresponding to the second configuration of the drum.

7. A razor according to claim 1, wherein movement of the actuating mechanism moves the drum in a corresponding manner.

8. A wet razor comprising:

a handle;

at least a first and a second shaving head; and a drum that includes said at least first and second shaving head, wherein each of the first and second shaving heads are elongated and extend along a first and a second head axis, wherein the first shaving head has one or more blades, each of the blades having one cutting edge extending parallel to the width of the first shaving head, wherein the second shaving head has one or more blades, each of the blades having one cutting edge extending parallel to the width of the second shaving head, said drum being pivotally mounted onto said handle about an axis substantially perpendicular to the cutting edges of the blades of said at least first and second shaving head, the pivoting of said drum allowing selective use of the first shaving head or of the second shaving head, the drum being capable of pivoting between at least a first configuration in which said first shaving head projects at a front end of said handle to allow shaving while said second shaving head is at least partly covered by said handle, and a second configuration in which the positions of said first shaving head and said second shaving head are reversed, and an actuating mechanism connected to said drum that causes rotation of said drum between the first and second configurations and including a manually operable actuator slidingly mounted on the handle to actuate the pivoting of said drum, wherein said at least first and second shaving head are parallel and diametrically opposed from each other with respect to said drum, and wherein said at least first and second shaving head face away from each other.

9. A razor according to claim 8, wherein the actuating mechanism includes a gear attached to said drum and a rack engaging the gear and attached to the manually operable actuator slidingly mounted on said handle.

10. A razor according to claim 9, wherein the rack is slidingly mounted in a longitudinal groove formed in the front end of the handle, between a first extreme position, corresponding to the first configuration of the drum, and a second extreme position, corresponding to the second configuration of the drum.

11. A wet razor comprising:

a handle;

at least a first and a second shaving head, each of the first and second shaving heads being elongated and extend along a first and a second longitudinal head axis, wherein the first shaving head has one or more blades, each of the blades having one cutting edge extending parallel to the width of the first shaving head, wherein the second shaving head has one or more blades, each of the blades having one cutting edge extending parallel to the width of the second shaving head;

a drum that includes said at least first and second shaving head, wherein said drum is pivotally mounted onto said handle about an axis substantially perpendicular to the cutting edges of the blades of said at least first and second shaving head for allowing a selective use of the first shaving head or of the second shaving head, and an actuating mechanism connected to said drum that causes rotation of said drum between a first configuration in which the first shaving head projects at a front end of said handle to allow shaving while said second shaving head is at least partly covered by said handle, and a second configuration in which the positions of said first shaving head and said second shaving head are reversed, the actuating mechanism including a manually operable actuator slidingly mounted on the handle to actuate the pivoting of said drum.

12. A razor according to claim 11, wherein the actuating mechanism includes a gear attached to said drum and a rack engaging the gear and attached to the manually operable actuator slidingly mounted on said handle.

* * * * *